US007173588B2

(12) United States Patent
Katagawa et al.

(10) Patent No.: US 7,173,588 B2
(45) Date of Patent: Feb. 6, 2007

(54) MATRIX DISPLAY DEVICE HAVING SWITCHING CIRCUIT FOR SELECTING EITHER A PICTURE VOLTAGE OR A PRE-WRITE VOLTAGE FOR PICTURE ELEMENTS

(75) Inventors: Koichi Katagawa, Kawasaki (JP); Katsunori Tanaka, Kawasaki (JP); Katsuhiko Kishida, Kawasaki (JP); Toshiaki Suzuki, Kawasaki (JP)

(73) Assignee: Sharp Kabushiki Kaisha, Osaka (JP)

( * ) Notice: Subject to any disclaimer, the term of this patent is extended or adjusted under 35 U.S.C. 154(b) by 212 days.

(21) Appl. No.: 10/095,137

(22) Filed: Mar. 11, 2002

(65) Prior Publication Data

US 2003/0095117 A1 May 22, 2003

(30) Foreign Application Priority Data

Nov. 22, 2001 (JP) ..... 2001-358351

(51) Int. Cl.
*G09G 3/36* (2006.01)

(52) U.S. Cl. ..... 345/89; 345/98; 345/204; 345/690

(58) Field of Classification Search ..... 345/87–103, 345/208–210, 204–205, 690–692
See application file for complete search history.

(56) References Cited

U.S. PATENT DOCUMENTS 5,686,936 A * 11/1997 Maekawa et al. ..... 345/100
6,313,819 B1 * 11/2001 Maekawa et al. ..... 345/92
6,320,565 B1 * 11/2001 Albu et al. ..... 345/98
6,473,077 B1 10/2002 Takenaka et al.
6,483,494 B1 * 11/2002 Liaw et al. ..... 345/92
6,600,469 B1 * 7/2003 Nukiyama et al. ..... 345/87
6,636,196 B2 * 10/2003 Janssen et al. ..... 345/103
6,661,402 B1 * 12/2003 Nitta et al. ..... 345/99
2002/0075221 A1 * 6/2002 Waterman ..... 345/99
2003/0025665 A1 * 2/2003 Janssen et al. ..... 345/98

FOREIGN PATENT DOCUMENTS

| | | | |
|---|---|---|---|
| JP | 04042211 | | 2/1992 |
| JP | 6-067148 | | 3/1994 |
| JP | 10097224 | * | 4/1998 |
| JP | 11142807 | | 5/1999 |
| JP | 2000-122596 | | 4/2000 |
| JP | 2000-284254 | | 10/2000 |
| JP | 2000-298259 | | 10/2000 |
| JP | 2001-042282 | | 2/2001 |
| JP | 2001-125546 | | 5/2001 |

* cited by examiner

*Primary Examiner*—Lun-yi Lao
(74) *Attorney, Agent, or Firm*—Greer, Burns & Crain, Ltd.

(57) ABSTRACT

In a liquid crystal display device in which picture elements are arranged in a matrix form, a fixed time before a display data voltage is supplied to the picture element by a data line and a scan line, a pre-write voltage at a gradation value having a high speed of response to a change in gradation is supplied to the picture element regardless of the gradation value of a picture after response. When the display data voltage is supplied to the picture element, the pre-write voltage is always supplied to the picture element to thereby increase the response speed of liquid crystal constituting the liquid crystal display device regardless of the gradation value of a picture after response, so as to display quickly a picture on a display section.

19 Claims, 10 Drawing Sheets

| GRADATION BEFORE RESPONSE \ GRADATION AFTER RESPONSE | 1 (BLACK) | 16 | 32 | 48 | 64 (WHITE) |
|---|---|---|---|---|---|
| 1 (BLACK) | | E | E | D | A |
| 16 | A | | D | B | A |
| 32 | A | D | | C | A |
| 48 | A | B | C | | A |
| 64 (WHITE) | A | A | A | A | |

A B C D E
FAST ← → LATE

PRIOR ART

F I G. 10

| | | GRADATION AFTER RESPONSE | | | | |
|---|---|---|---|---|---|---|
| | | 1 (BLACK) | 16 | 32 | 48 | 64 (WHITE) |
| GRADATION BEFORE RESPONSE | 1 (BLACK) | | E | E | D | A |
| | 16 | A | | D | B | A |
| | 32 | A | D | | C | A |
| | 48 | A | B | C | | A |
| | 64 (WHITE) | A | A | A | A | |

A B C D E

FAST ← → LATE

MATRIX DISPLAY DEVICE HAVING SWITCHING CIRCUIT FOR SELECTING EITHER A PICTURE VOLTAGE OR A PRE-WRITE VOLTAGE FOR PICTURE ELEMENTS

CROSS-REFERENCE TO RELATED APPLICATIONS

This application is based upon and claims priority of Japanese Patent Application No. 2001-358351, filed on Nov. 22, 2001, the contents being incorporated herein by reference.

BACKGROUND OF THE INVENTION

1. Field of the Invention

The present invention relates to a matrix display device and a driving method thereof and, more specifically, to one suitable to be used in a liquid crystal display device in which picture elements are arranged in a matrix form.

2. Description of the Related Art

In recent years, the, field has seen the widespread use of matrix display devices such as a liquid crystal display device in which picture elements are arranged in a matrix form in place of a conventional CRT and the like because of the need for energy saving (reduced power consumption) and space saving (reduced size) of a display device. What have come into wide use are desktop personal computers, liquid crystal televisions and the like in which the aforementioned liquid crystal display devices are used as monitors.

For example, in the liquid crystal display device which is one of the matrix display devices, a plurality of scan lines and a plurality of data lines are arranged in a matrix form and display picture elements for displaying images are arranged at intersections of the scan lines and the data lines. In this liquid crystal display device, the scan lines and the data lines are driven such that the data lines are scanned one by one in sequence by means of the scan lines to apply a display voltage in accordance with the gradation of an image to be displayed to each display picture element through the data line. Thus, the liquid crystal display device displays a desired image by applying the display data voltage to liquid crystal corresponding to each display picture element to align the liquid crystal and controlling transmission of light of a backlight.

The conventional liquid crystal display device as described above, however, has a problem that the response speed required after the display data voltage is applied to the liquid crystal and until the liquid crystal demonstrates the alignment according thereto (responds thereto) is uneven in accordance with the gradation of pictures before and after the response, that is, display data voltages applied to the liquid crystal before and after the response as shown in FIG. 10.

FIG. 10 is a table showing an example of the response speed of the liquid crystal to a change in gradation of a picture.

In FIG. 10, gradation values of pictures before response are shown in the vertical direction, and gradation values after response, that is, gradation values of pictures to be displayed are shown in the horizontal direction. The gradation value of picture "1" shall display black and "64" shall display white. The gradation values of pictures of "16", "32" and "48" are intermediate gradation levels between black and white, in which the picture becomes brighter (becomes closer to white) as the gradation value increases.

Further, response speeds of the liquid crystal to changes in gradation are indicated by symbols A to E in respective boxes at intersections of gradation values of pictures before and after response. The symbols A to E show that the response speeds become lower in an order from A, B, C, D to E, in which the symbol A is the highest response speed and the symbol E is the lowest response speed.

In FIG. 10, for example, in the case where the gradation value of a picture before response is "1" and the gradation value of a picture after response is "32", the response speed of the liquid crystal is the lowest (symbol E). Meanwhile, in the case of the gradation value of a picture after response of "64", the response speed of the liquid crystal is the highest (symbol A) regardless of the gradation value of a picture before response.

Because of unevenness in response speed of the liquid crystal depending on the gradation of pictures before and after response, an afterimage is caused by the unevenness in response speed of the liquid crystal when videos are displayed in the conventional liquid crystal display device, which presents a problem that pictures can not be viewed clearly.

As a method for suppressing the afterimage caused by the unevenness in response speed of the liquid crystal, there is a method of ON-OFF controlling the backlight of the liquid crystal display device during display to light the backlight like pulses by driving the backlight as a CRT so as to suppress the afterimage visible to an observer. By the aforesaid method, however, high effects can not be obtained for suppressing the afterimage visible to the observer because the response speed of the liquid crystal itself of the liquid crystal display device is very low to some change in gradation.

SUMMARY OF THE INVENTION

The present invention is made to solve such problems, and it is an object of the invention to increase the response speed in a display device regardless of the gradation of pictures before and after response so as to display quickly a picture.

A matrix display device of the present invention supplies a pre-write voltage differing from a picture voltage according to a picture to a picture element for displaying a picture a predetermined time before the picture voltage is supplied to the picture element.

According to the invention structured as above, a voltage quickly responsive to a change in gradation of a picture is supplied to the picture element as a pre-write voltage, which makes it possible to increase the response speed regardless of the gradation of a picture after response.

BRIEF DESCRIPTION OF THE DRAWINGS

FIG. 10 is a table showing an example of a speed of a picture element of response to a change in gradation.

DETAILED DESCRIPTION OF THE PREFERRED EMBODIMENTS

Hereafter, the preferred embodiments of the present invention will be described based on the drawings.

First Embodiment

Figure 1:
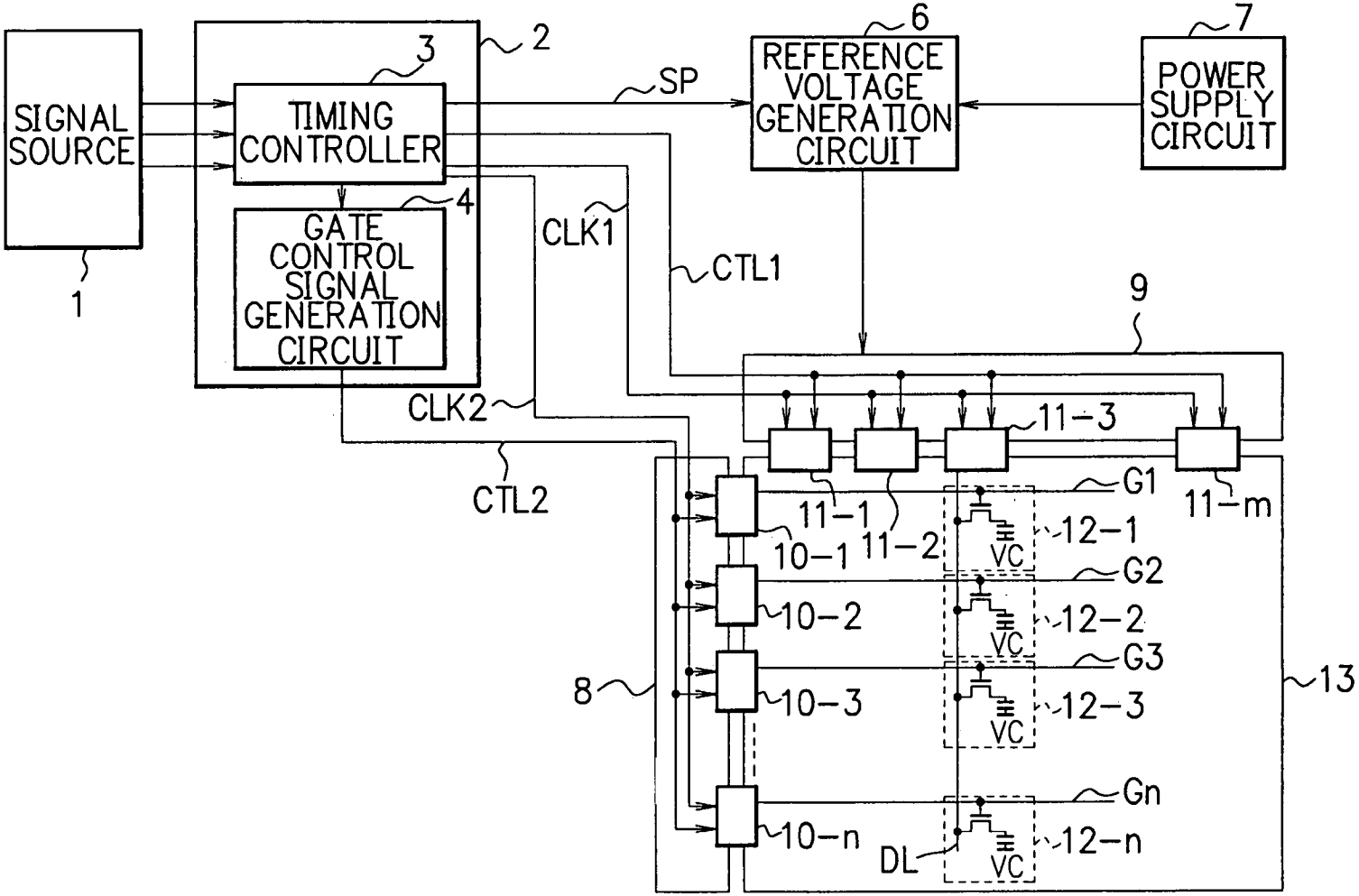
FIG. 1 is a block diagram showing a configuration example of a liquid crystal display device to which a matrix display device according to a first embodiment is applied.

FIG. 1 is a block diagram showing a configuration example of a liquid crystal display device to which a matrix display device according to the first embodiment of the present invention is applied.

In FIG. 1, numeral 1 denotes a signal source which supplies to a control circuit 2 a clock signal, a display signal and so on for causing a display section (liquid crystal panel) 13 to display an image.

The control circuit 2, which is a circuit for controlling a gate drive circuit 8, a data drive circuit 9 and so on, includes a timing controller 3 and a gate control signal generation circuit 4. The timing controller 3 generates a switching pulse SP based on the clock signal, the display signal and so on supplied from the signal source 1 and outputs it to a reference voltage generation circuit 6. Further, the timing controller 3 outputs a signal for generating a gate control signal to the gate control signal generation circuit 4 based on the clock signal, the display signal and so on supplied from the signal source 1.

Furthermore, the timing controller 3 generates and outputs a control signal CTL1 for controlling the data drive circuit 9 and clock signals CLK2 and CLK1 for causing the gate drive circuit 8 and the data drive circuit 9 to operate respectively based on the clock signal, the display signal and so on supplied from the signal source 1.

The gate control signal generation circuit 4 generates and outputs a control signal CTL2 for controlling the gate drive circuit 8 based on the signal supplied from the timing controller 3.

The reference voltage generation circuit 6 divides a voltage supplied from a power supply circuit 7 using a resistance or the like and supplies to the date drive circuit 9 several kinds of reference voltages obtained by the voltage division and a pre-write voltage supplied from the power supply circuit 7.

The gate drive circuit 8 is constituted by a plurality of gate drivers 10-1 to 10-n (n represents a natural number) each for forming a timing of taking data (voltage) into a picture element. The gate drivers 10-1 to 10-n drive a plurality of scan lines included in the display section 13 in sequence by driving the scan lines in the display section 13 respectively based on the clock signal CLK2 supplied from the timing controller 3 and the control signal CTL2 supplied from the gate signal generation circuit 4.

In the display section 13, the plurality of scan lines and the plurality of data lines are arranged in a matrix form, and picture elements for displaying an image are arranged at intersections of the scan lines and the data lines. The aforesaid scan lines and data lines are driven and controlled by the above-described plurality of gate drivers 10-1 to 10-n and plurality of data drivers 11-1 to 11-m respectively, so that an image according to the display signal supplied from the signal source 1 is displayed on the display section 13.

Incidentally, FIG. 1 shows only scan lines G1 to Gn, a data line DL, and picture elements 12-1 to 12-n which are provided at intersections of the scan lines Gl to Gn and the data line DL for convenience of explanation.

The picture elements 12-1 to 12-n are constituted by MOS transistors and capacitors respectively. The gate of the MOS transistor is connected to the scan line, the drain (source) is connected to the data line, and the source (drain) is connected to one of electrodes of the capacitor. Further, the other electrode of the capacitor is connected to a common electrode which supplies a common voltage VC.

Figure 2A:
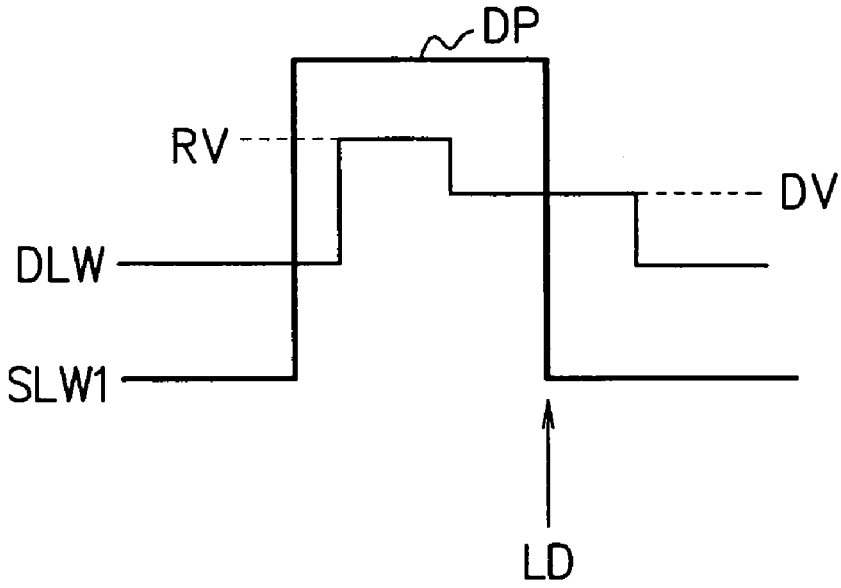
FIGS. 2A and 2B are charts showing driving waveforms for driving the liquid crystal display device in the first embodiment.
Figure 2B:
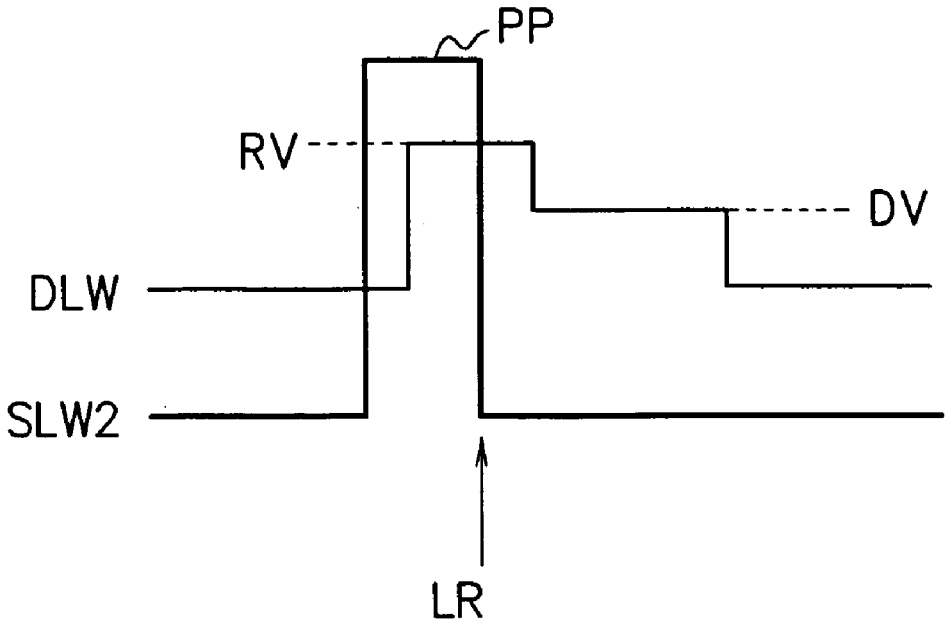

FIGS. 2A and 2B are diagrams showing examples of driving waveforms at the time of driving the scan lines and the data lines by the plurality of gate drivers 10-1 to 10-n and the plurality of data drivers 11-1 to 11-m in the liquid crystal display device shown in FIG. 1. FIG. 2A shows a driving waveform at the time of writing display data, and FIG. 2B shows a driving waveform at the time of preliminarily writing.

In FIG. 2A, SLW1 represents a driving waveform of the scan line, and DP represents a display data write pulse. Further, DLW represents a driving waveform of the data line, in which RV represents a pre-write voltage and DV represents a display data voltage. As described above, the data waveform applied to the data line, which has been only at the display data voltage DV conventionally, is made in this embodiment such that a part of the data waveform is at the pre-write voltage RV during a predetermined period of time and thereafter at the display data voltage DV. It should be noted that the pre-write voltage RV is preferably a voltage corresponding to a gradation value of "64", that is, white data, having a speed of response to a change in gradation being always the highest regardless of the gradation value of a picture after response as shown in FIG. 10.

As shown in FIG. 2A, the display data write pulse DP supplied to the scan line at the time of writing display data falls at a point of time LD while the display data voltage DV is applied to the data line to thereby supply (write) the display data voltage DV to the picture element.

In FIG. 2B, SLW2 represents a driving waveform of the scan line as in FIG. 2A, and DLW represents a driving waveform of the data line. Further, PP represents a pre-write pulse. At the time of preliminarily writing, the pre-write pulse PP supplied to the scan line falls at a point of time LR while the pre-write voltage RV is applied to the data line to thereby supply (write) the pre-write voltage RV to the picture element.

Figure 3:
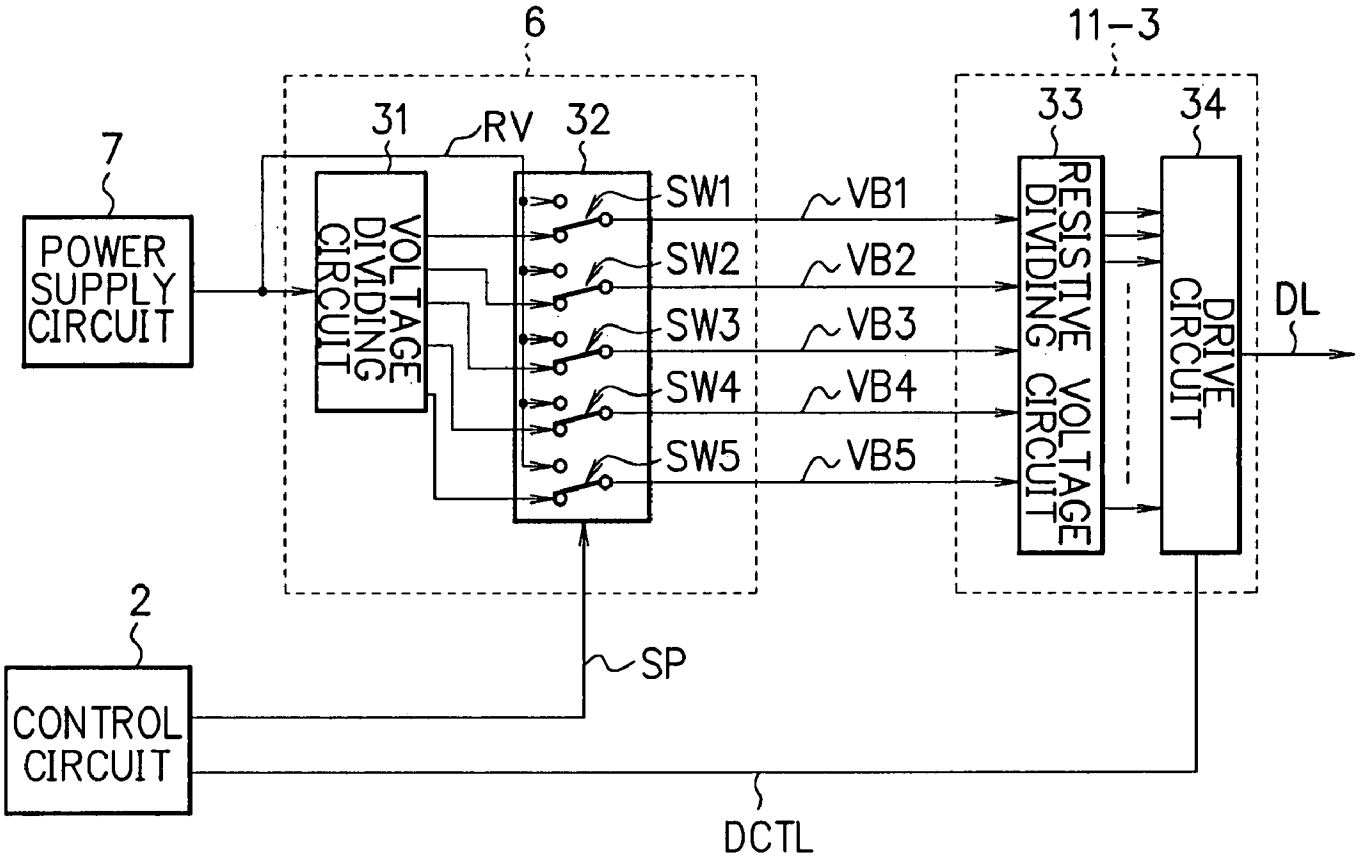
FIG. 3 is a diagram for explaining operation of generating a display data voltage and a pre-write voltage.

In this event, the display data voltage DV and the pre-write voltage RV are generated as shown in FIG. 3.

FIG. 3 is a diagram for explaining operation of generating the display data voltage DV and the pre-write voltage RV in the operation of driving the data line. Incidentally, blocks and the like in FIG. 3 having the same functions as those of the blocks and the like shown in FIG. 1 are assigned the same numerals and symbols.

In FIG. 3, the reference voltage generation circuit 6 is constituted by a voltage dividing circuit 31 and a switching circuit 32. The voltage dividing circuit 31 divides the voltage supplied from the power supply circuit 7 using a resistance or the like and supplies them to the switching circuit 32. The switching circuit 32 is constituted by a plurality of three-terminal switches SW1 to SW5 each provided with two input terminals and one output terminal.

One of the input terminals of each of the three-terminal switches SW1 to SW5 is supplied with one of the reference voltages which are obtained by the voltage division and differ from one another supplied from the voltage dividing circuit 31, and the other input terminal is supplied with the pre-write voltage RV supplied from the power supply circuit 7. Further, the three-terminal switches SW1 to SW5 are controlled in synchronization with one another by the switching pulse SP supplied from the control circuit 2. Therefore, the reference voltages which are obtained by the voltage division and differ from one another or the pre-write voltages RV are supplied as voltages VB1 to VB5 from the three-terminal switches SW1 to SW5 to the data driver 11-3 in the data drive circuit 9.

The data driver 11-3 is constituted by a resistive voltage dividing circuit 33 and a drive circuit 34. The resistive voltage dividing circuit 33 divides the voltages VB1 to VB5 supplied from the reference voltage generation circuit 6 with a resistance to generate 64-level gradation voltages, and supplies them to the drive circuit 34. The drive circuit 34 outputs to the data line DL one of the voltages supplied from the resistive voltage dividing circuit 33 in accordance with a data control signal DCTL included in the control signal CTL1 supplied from the control circuit 2.

Therefore, when the voltages VB1 to VB5 supplied from the reference voltage generation circuit 6 are reference voltages obtained by the voltage division and differing from one another, the data driver 11-3 outputs to the data line DL one of the 64-level gradation voltages. Meanwhile, when the supplied voltages VB1 to VB5 are the pre-write voltages RV, the data driver 11-3 outputs to the data line DL the pre-write voltage.

It should be noted that the pre-write voltage RV is supplied from the power supply circuit 7 to the switching circuit 32 in the reference voltage generation circuit 6 in distinction from the normal voltage in FIG. 3, but any one of the reference voltages (for example, a voltage showing the highest voltage value) obtained by the voltage dividing circuit 31 may be supplied to the switching circuit 32 as the pre-write voltage RV. Moreover, this embodiment shows a case where 64-level gradation can be displayed in the display section 13, but in the case of 256-level gradation capable of being displayed in the display section 13, it is preferable to divide the voltages VB1 to VB5 with resistance in the resistive voltage dividing circuit 33.

Figure 4A:
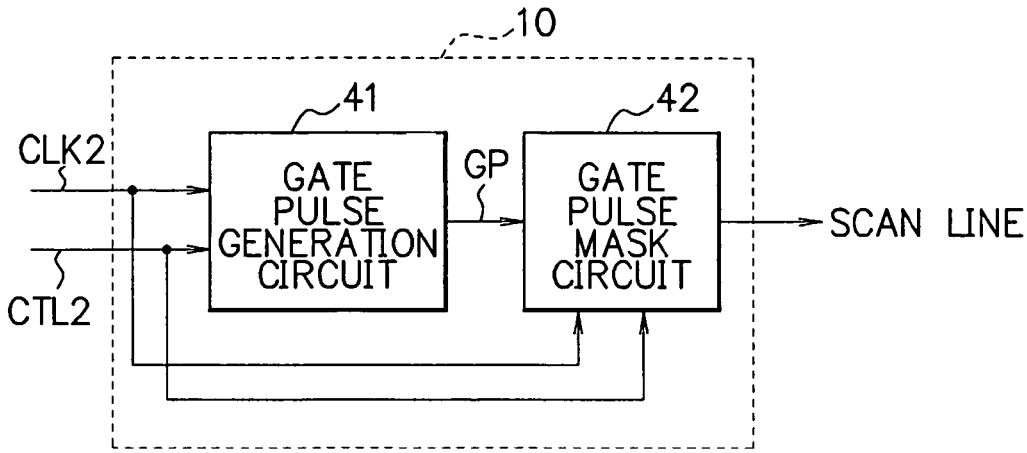
FIGS. 4A and 4B are a diagram and a chart for explaining the operation of generating a display data write pulse and a pre-write pulse.
Figure 4B:
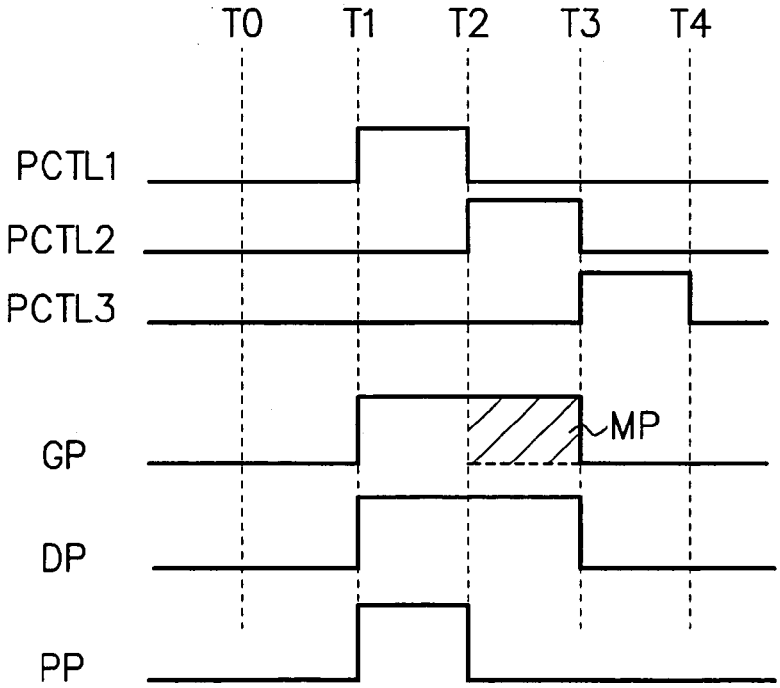

The display data write pulse DP and the pre-write pulse PP shown in FIGS. 2A and 2B are generated as shown in FIGS. 4A and 4B.

FIG. 4A is a diagram for explaining operation of generating the display data write pulse DP and the pre-write pulse PP in the operation of driving the scan line.

In FIG. 4A, 10 represents a gate driver which includes a gate pulse generation circuit 41 and a gate pulse mask circuit 42. The gate pulse generation circuit 41 generates a gate pulse GP corresponding to the display data write pulse DP and supplies it to the gate pulse mask circuit 42 based on the clock signal CLK2 and the control signal CTL2 supplied from the control circuit 2.

The gate pulse mask circuit 42 determines whether or not to perform mask processing on the gate pulse GP supplied from the gate pulse generation circuit 41 based on the clock signal CLK2 and the control signal CTL2 supplied from the control circuit 2. Further, the gate pulse mask circuit 42 performs mask processing on the gate pulse GP in accordance with the determined result and outputs it to the scan line.

Specifically, the gate pulse mask circuit 42 determines whether to scan the scan line to perform display data writing or to scan the scan line to perform preliminary writing based on the control signal CTL2 and so on supplied from the control circuit 2. As a result of the above determination, when the gate pulse mask circuit 42 determines to perform display data writing, it does not perform mask processing on the gate pulse GP and outputs it as the display data write pulse DP. On the other hand, when the gate pulse mask circuit 42 determines to perform preliminary writing, it performs mask processing on the gate pulse GP and outputs it as the pre-write pulse PP.

FIG. 4B is a chart for explaining a principle of generating the display data write pulse DP and the pre-write pulse PP.

In FIG. 4B, PCTLs 1 to 3 are pulse control signals included in the control signal CTL2. For example, as shown in FIG. 4B, the pulse control signal PCTL2 is outputted one clock after the pulse control signal PCTL1 (a point of time T2), and the pulse control signal PCTL3 is outputted one clock after the pulse clock signal PCTL2 (a point of time T3).

At a point of time T1, a gate pulse GP having a width of two clocks is generated in the gate pulse generation circuit 41 with rise of the pulse control signal PCTL1. When display data writing is performed, the generated gate pulse GP is subjected to no processing in the gate pulse mask circuit 42 and is outputted as the display data write pulse DP. On the other hand, when preliminary writing is performed, the generated gate pulse GP, a hatched part MP of which is subjected to mask processing in the gate pulse mask circuit 42 using the pulse control signal PCTL2, is outputted as the pre-write pulse PP having a pulse width smaller than that of the display data write pulse DP.

Next, operation of the liquid crystal display device shown in FIG. 1 will be explained.

Incidentally, the following explanation is made only on the scan line and the data line in the display section 13.

Figure 5:
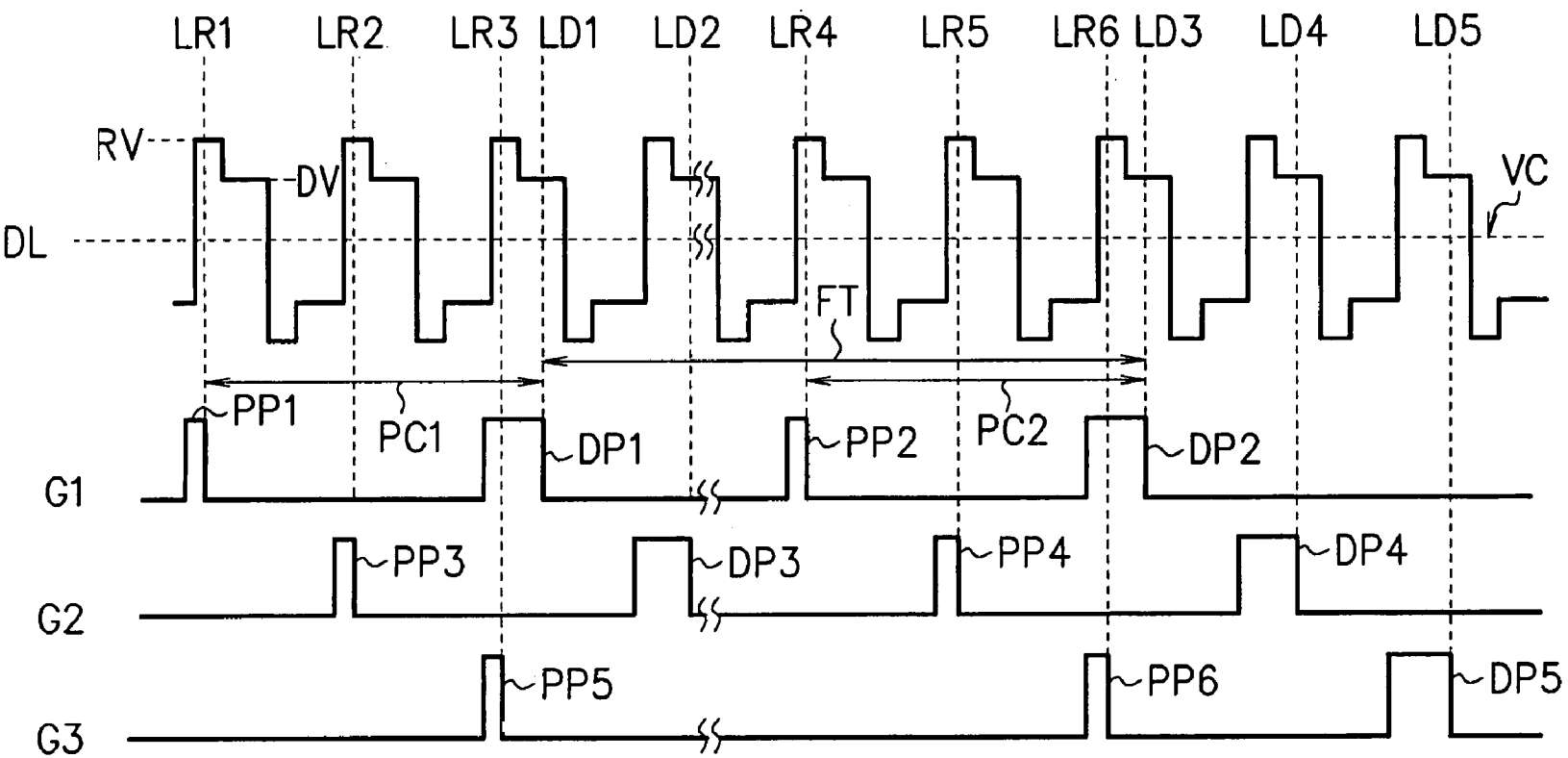
FIG. 5 is a timing chart showing the operation of the liquid crystal display device in the first embodiment.

FIG. 5 is a timing chart showing the operation of the liquid crystal display device shown in FIG. 1. In the liquid crystal display device, normally there exist a positive field driven by a positive voltage and a negative field driven by a negative voltage with respect to the common voltage VC. FIG. 5 shows only driving waveforms of three scan lines and one data line in the positive field for convenience of explanation. Incidentally, driving waveforms in the negative field are the same as those shown in FIG. 5 with only the voltage polarity being opposite thereto with respect to the common voltage.

As shown in FIG. 5, the data line DL is driven in such a manner to apply the pre-write voltage RV being at a fixed voltage value and then apply the display data voltage DV being at a voltage value according to display data. Further, the data line DL is also driven in such a manner that a pair of pre-write voltage RV and display data voltage DV are alternate (positive voltage, negative voltage, positive voltage, and so on) with respect to the common voltage VC.

In FIG. 5, a pre-write pulse PP1 is first supplied to the scan line G1, and then the pre-write pulse PP1 falls at a point of time LR1, so that the pre-write voltage RV is supplied to a picture element arranged at the intersection of the scan line G1 and the data line DL. Thereby, the pre-write voltage RV is applied to liquid crystal corresponding to the picture element arranged at the intersection of the scan line G1 and the data line DL.

Next, a pre-write pulse PP3 is similarly supplied to the scan line G2, and then the pre-write pulse PP3 falls at a point of time LR2, so that the pre-write voltage RV is applied to liquid crystal corresponding to a picture element arranged at the intersection of the scan line G2 and the data line DL.

Further, concurrently with a display data write pulse DP1 being supplied to the scan line G1, a pre-write pulse PP5 is supplied to the scan line G3. In this event, the pre-write pulse PP5 which has been supplied to the scan line G3 first falls at a point of time LR3, so that the pre-write voltage RV is applied to liquid crystal corresponding to a picture element arranged at the intersection of the scan line G3 and the data line DL. Thereafter, the display data write pulse DP1 which has been supplied to the scan line G1 falls at a point of time LD1, so that the display data voltage DV is supplied to the picture element arranged at the intersection of the scan line G1 and the data line DL. Thereby, the display data voltage DV is applied to the liquid crystal corresponding to the picture element arranged at the intersection of the scan line G1 and the data line DL, so that an image of the gradation according to the display data voltage DV is displayed.

Further, after a lapse of a frame period FT after the supply of the pre-write pulse PP1 to the scan line G1, a pre-write pulse PP2 is supplied again to the scan line G1. The pre-write pulse PP2 falls at a point of time LR4, so that the pre-write voltage RV is applied again to the liquid crystal corresponding to the picture element arranged at the intersection of the scan line G1 and the data line DL.

Thereafter, a pre-write pulse PP4 is similarly supplied to the scan line G2, so that the pre-write voltage RV is applied again at a point of time LR5 to the liquid crystal corresponding to the picture element arranged at the intersection of the scan line G2 and the data line DL.

Subsequently, concurrently with a display data write pulse DP2 being supplied to the scan line G1, a pre-write pulse PP6 is supplied to the scan line G3. Thereby, the pre-write voltage RV is first, at a point of time LR6, applied to the liquid crystal corresponding to the picture element arranged at the intersection of the scan line G3 and the data line DL. Thereafter, at a point of time LD3, the display data voltage DV is supplied to the picture element arranged at the intersection of the scan line G1 and the data line DL.

The above-described operation is repeated to display a desired picture on the display section 13.

In FIG. 5, PC1 and PC2 represent pre-write periods here. The pre-write periods PC1 and PC2 are periods of time after the pre-write voltage RV is applied to a picture element (a picture element fetches the pre-write voltage RV) and until the display data voltage DV is applied to the picture element (the picture element fetches the display data voltage DV). The pre-write periods PC1 and PC2 are preferably about 1 ms to about 3 ms so that an observer can not recognize an image displayed in accordance with the applied pre-write voltage RV.

As has been described in detail, according to this embodiment, in a liquid crystal display device in which a plurality of data lines and a plurality of scan lines are arranged in a matrix form and picture elements are arranged at intersections of the aforesaid data lines and the aforesaid scan lines, a pre-write voltage RV at a gradation value having a high speed of response to a change in gradation regardless of the gradation value of a picture after response is supplied to the picture element only a pre-write period before a display data voltage DV is supplied to the picture element by the data line and the scan line.

As a result, in the case where the display data voltage DV is supplied to the picture element, the pre-write voltage RV having a high speed of response to a change in gradation regardless of the gradation value of a picture after response is always supplied to the picture element, which makes it possible to increase the response speed of the liquid crystal constituting the liquid crystal display device regardless of the gradation value of a picture after response, that is, the display data voltage DV, so that a picture can be displayed quickly on the display section 13. Therefore, unevenness in response speed of the liquid crystal depending on the gradation levels of pictures before and after response, which occurs in a conventional liquid crystal display device, is eliminated and there appears no afterimage even if videos are displayed, so that a picture can be displayed clearly.

Second Embodiment

In the above-described liquid crystal display device in the first embodiment, for example, when display data for displaying a black image is supplied to the picture element, the contrast of the picture may decrease if the pre-write voltage RV is supplied to the picture element in the pre-write operation. Thus, a liquid crystal display device to which a matrix display device according to the second embodiment is applied is configured such that the pre-write voltage RV is applied in accordance with display data (display data voltage DV) to be supplied to the picture element. In the case of display data causing a decrease in contrast of a picture, a voltage differing from the pre-write voltage RV, for example, the display data voltage DV is applied.

Figure 6:
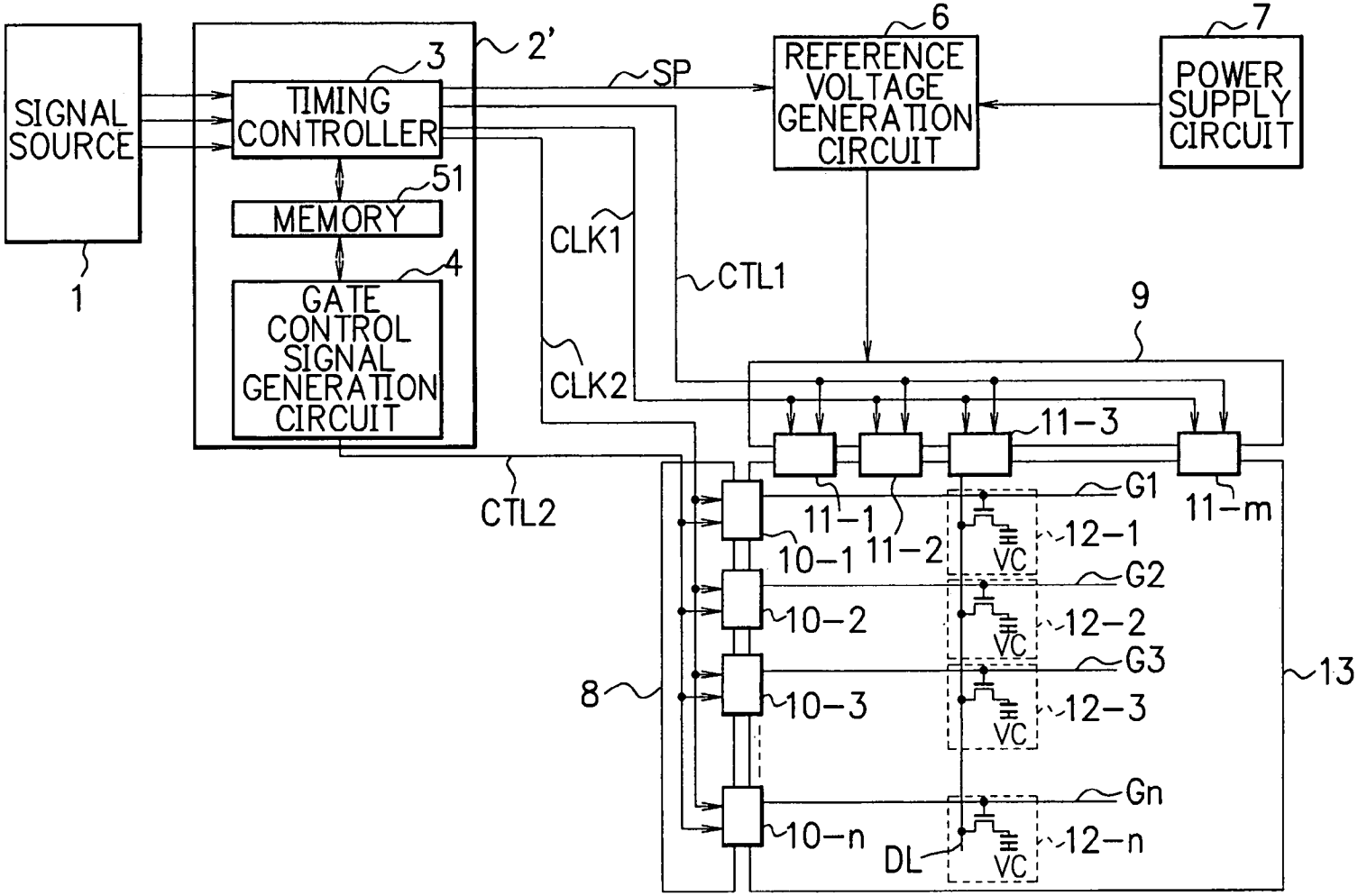
FIG. 6 is a block diagram showing a configuration example of the liquid crystal display device to which a matrix display device according to a second embodiment is employed.

FIG. 6 is a block diagram showing a configuration example of the liquid crystal display device to which the matrix display device according to the second embodiment of the present invention is applied.

Incidentally, blocks and the like in FIG. 6 having the same functions as those of the blocks and the like shown in FIG. 1 are assigned the same numerals and symbols, and duplicate explanation is omitted.

In FIG. 6, a control circuit 2' includes a timing controller 3 and a gate control signal generation circuit 4, and a memory 51 in addition. The memory 51, when a display signal causing a decrease in contrast of a picture is supplied from a signal source 1 to the timing controller 3, reads display data according to the display signal. Further, the memory 51 instructs a reference voltage generation circuit 6 and a data drive circuit 9 not to supply the pre-write voltage RV in the pre-write operation to the picture element which is supplied with the display data causing a decrease in contrast of a picture. Specifically, the memory 51 instructs the reference voltage generation circuit 6 and the data drive circuit 9 not to supply the pre-write voltage RV at a timing of originally performing the pre-write operation in the picture element which is supplied with the display data causing a decrease in contrast of a picture.

In response to the instruction, the reference voltage generation circuit 6 and the data drive circuit 9 instruct data drivers 11-1 to 11-m to supply voltages differing from the pre-write voltage RV (for example, the display data voltage DV) at timings of originally performing the pre-write operation to thereby prevent the pre-write voltage RV from being supplied to the picture elements.

Next, operation of the liquid crystal display device shown in FIG. 6 is explained.

It should be noted that the following explanation is made only on operation of driving the scan line and the data line in a display section 13.

Figure 7:
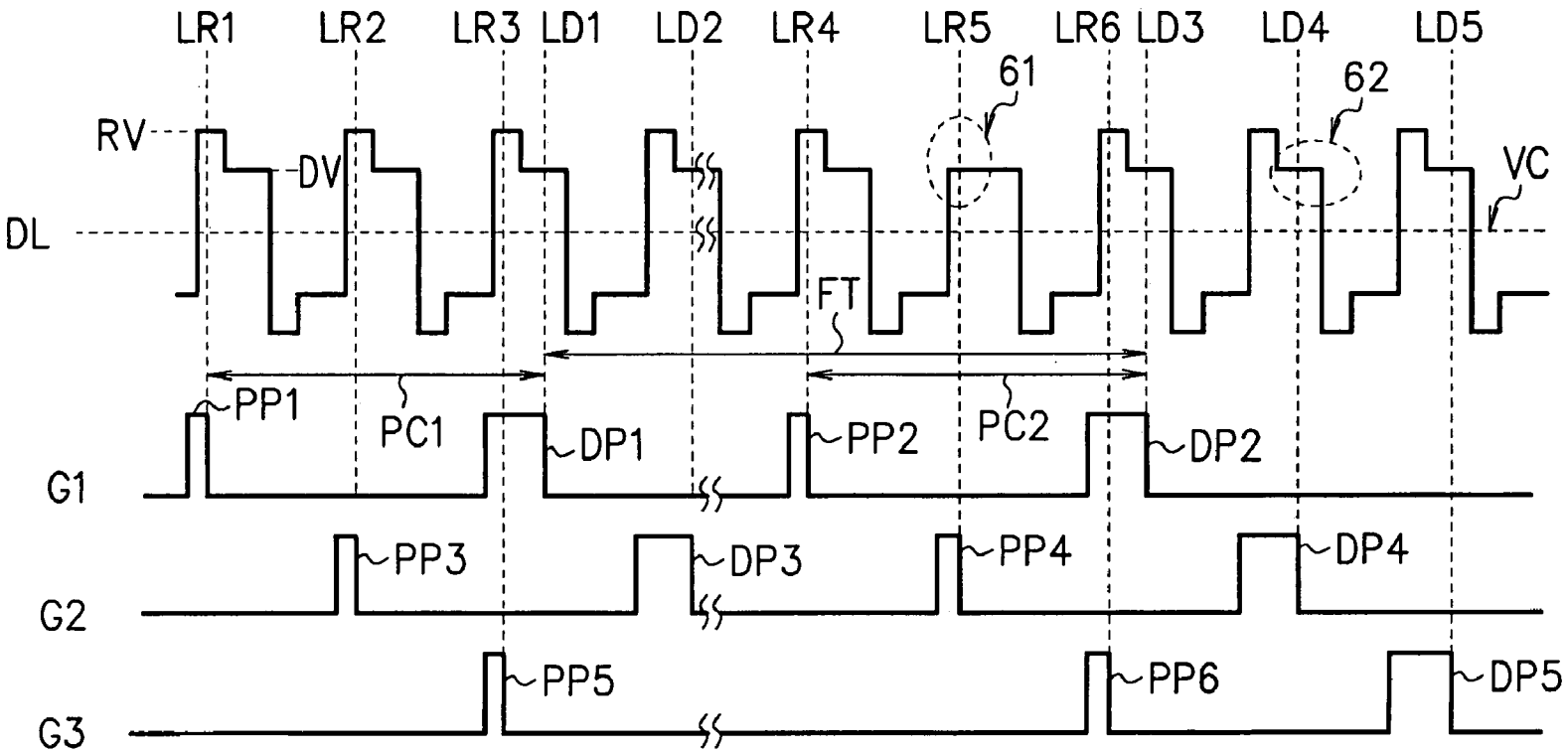
FIG. 7 is a timing chart showing the operation of the liquid crystal display device in the second embodiment.

FIG. 7 is a timing chart showing the operation of the liquid crystal display device shown in FIG. 6. Incidentally, FIG. 7 shows only driving waveforms of three scan lines and one data line in the positive field as in FIG. 5 for convenience of explanation.

The operation in the case where the display data voltage is applied after the pre-write voltage is applied in the pre-write operation in FIG. 7 is the same as that in the liquid crystal display device in the first embodiment shown in FIG. 5, and thus the explanation thereof is omitted.

It is assumed that the display data voltage DV of display data causing a decrease in contrast of a picture is supplied at a display data part 62 in FIG. 7. The display data part 62 is a data display voltage which is applied to liquid crystal corresponding to a picture element arranged at an intersection of a scan line G2 and a data line DL at a point of time LD4 where a display data write pulse DP4 falls.

In such a case, in the liquid crystal display device in the second embodiment, control is conducted so that the pre-write voltage RV is not applied to the picture element arranged at the intersection of the scan line G2 and the data line DL at a pre-write part 61 where the pre-write operation corresponding to the display data part 62 is performed.

In other words, when a pre-write pulse PP4 is supplied to the scan line G2, the control circuit 2' controls the reference voltage generation circuit 6 and the data drivers 11-1 to 11-m so as not to apply the pre-write voltage RV but to apply the display data voltage DV to the data line DL.

Therefore, the picture element arranged at the intersection of the scan line G2 and the data line DL is supplied with the display data voltage DV which is supplied to a picture element of a different scan line at a point of time LR5 where the pre-write pulse PP4 which has been supplied to the scan line G2 falls. Thereby, the liquid crystal corresponding to the picture element arranged at the intersection of the scan line G2 and the data line DL is supplied with the display data voltage DV.

Consequently, in the case of supplying the display data voltage DV causing a decrease in contrast of a picture if the pre-write voltage RV is supplied in the pre-write operation, the pre-write voltage RV is prevented from being supplied in the pre-write operation, which makes it possible to prevent a decrease in contrast of a picture.

It should be noted that, in the second embodiment, when the display data voltage DV causing a decrease in contrast of a picture is supplied to the picture element, the driving waveform of the data line is controlled not to supply the pre-write voltage RV in the pre-write operation in order to prevent a decrease in contrast of a picture. However, the driving waveform of the scan line may be controlled instead of controlling the driving waveform of the data line.

More specifically, at the time when a display signal causing a decrease in contrast of a picture is supplied from the signal source 51 to the timing controller 3, display data according to the display signal is read into the memory 51. Then, the memory 51 instructs the gate control signal generation circuit 4 to perform no pre-write operation for a picture element which is supplied with the display data causing a decrease in contrast of a picture. Based on this instruction, the gate control signal generation circuit 4 may instruct gate drivers 10-1 to 10-n not to output the pre-write pulses PP at timings of originally performing the pre-write operation.

Further, in the second embodiment, in the case where the display data voltage DV causing a decrease in contrast of a picture is supplied to the picture element, the display data voltage DV is used in place of the pre-write voltage RV in the pre-write operation in order to prevent a decrease in contrast of a picture but, not limited to the display data voltage DV, a fixed voltage is adoptable so as not to cause a decrease in contrast of a picture.

Figure 8:
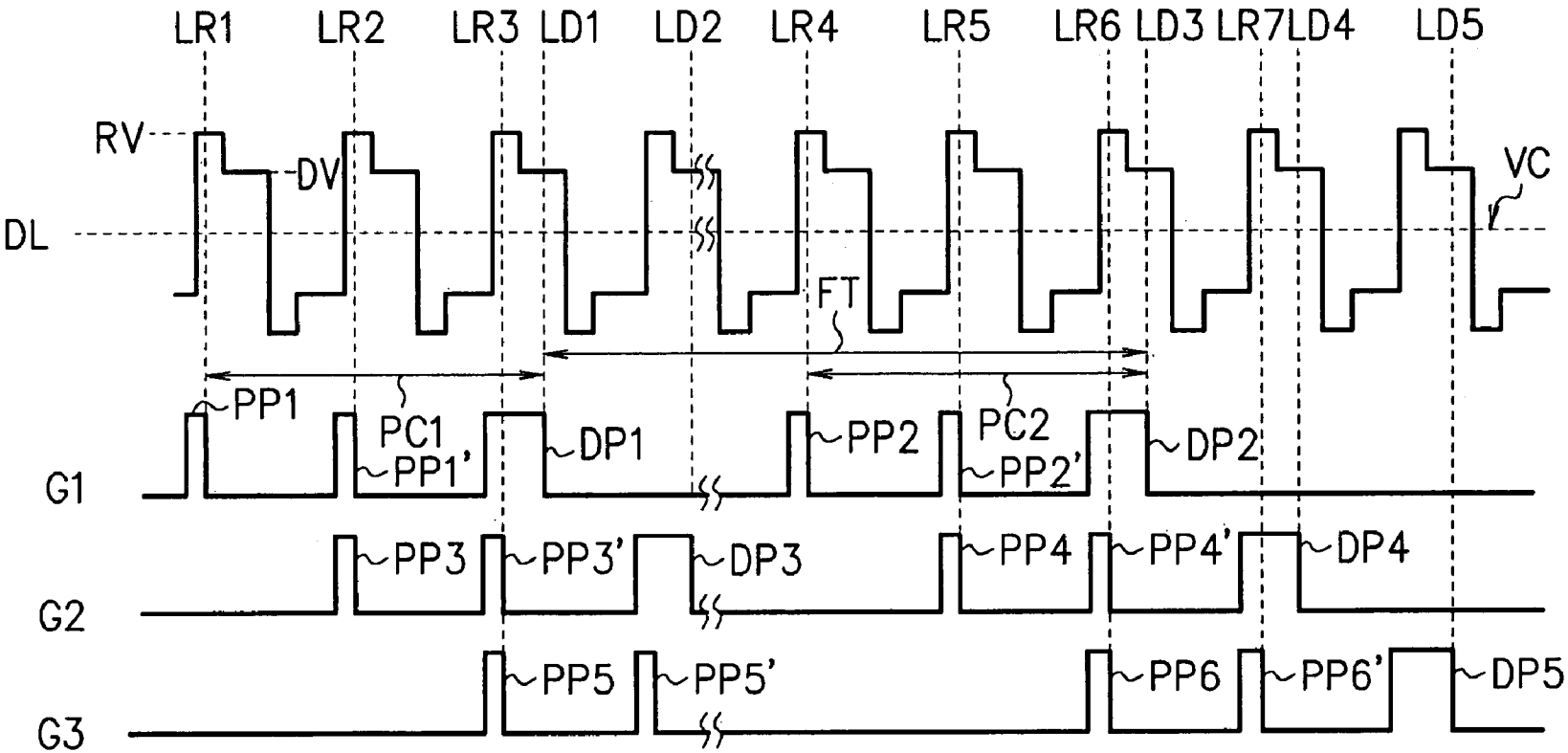
FIG. 8 shows another example of the timing chart showing the operation of the liquid crystal display device.

Further, in the above-described first and second embodiments one pre-write pulse PP is supplied the pre-write period PC 1 or PC 2 before one display data write pulse DP, but a plurality of pre-write pulses PP may be supplied in each of the pre-write periods PC 1 and PC 2. For example, as shown in FIG. 8, two pre-write pulses PP1 and PP1' may be supplied in the pre-write period PC1 for the display data write pulse DP1, so that two pre-write pulses PP may be supplied in each of the pre-write periods PC 1 and PC 2.

In the case where a plurality of pre-write pulses PP are supplied in the pre-write period as described above, it is possible to keep the pre-write voltage RV (for example, a voltage for displaying white) in a stable state and to increase stably the response speed when the display data voltage DV is written.

Further, the pre-write voltage RV and the display data voltage DV which are applied to the data line are generated in the reference voltage generation circuit 6 and the data driver 11-3 in the above-described first and second embodiments. Alternatively, the pre-write voltage RV and the display data voltage DV may be generated only in the data driver 11-3 or in another circuit.

Figure 9:
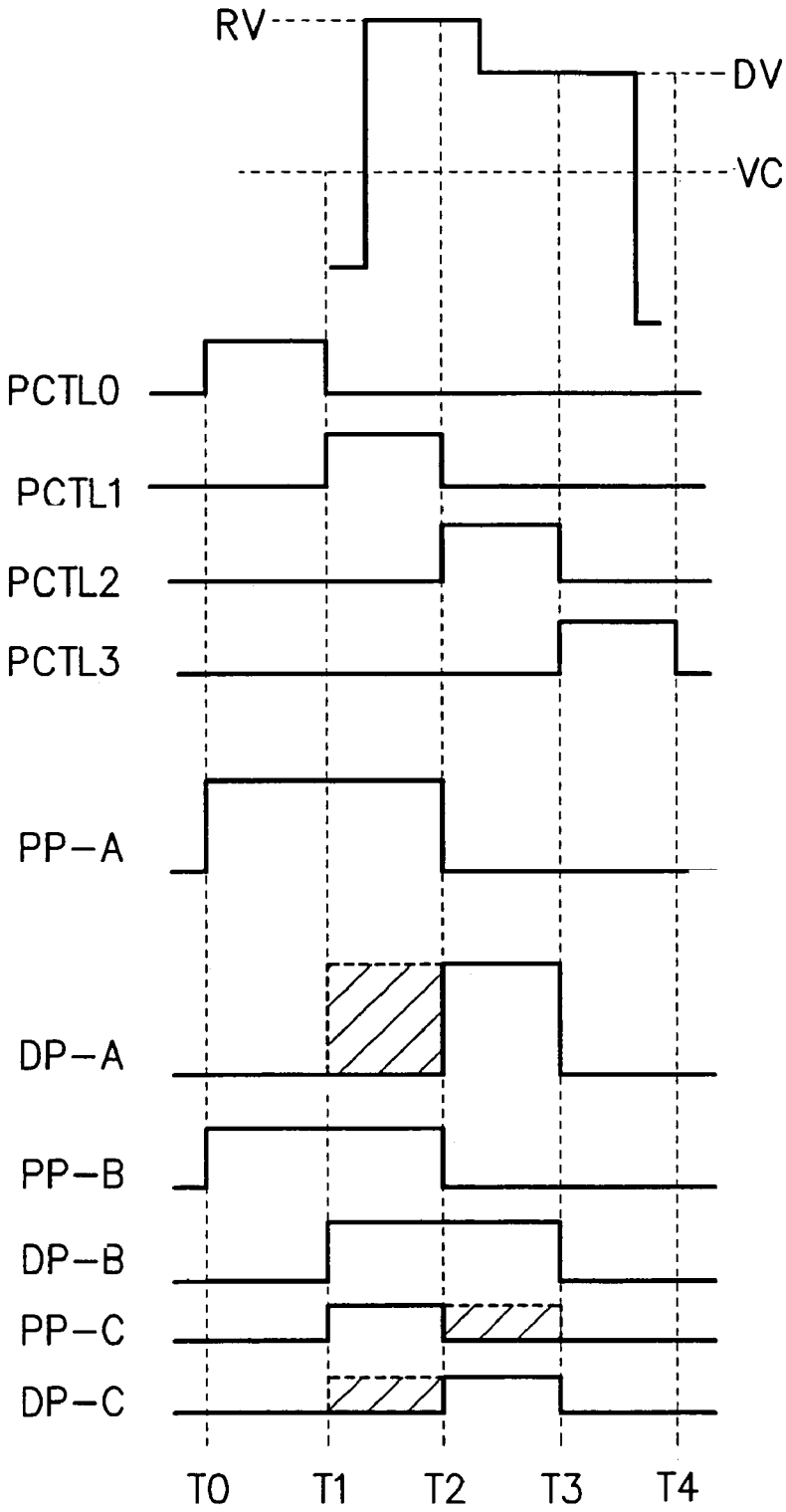
FIG. 9 is a diagram showing another example of the pre-write pulse and the display data write pulse.

Further, not limited to the pre-write pulse PP and the display data write pulse DP shown in the above-described first and second embodiments, it is also preferable to use pre-write pulses PP-A, PP-B and PP-C and display data write pulses DP-A, DP-B and DP-C as shown in FIG. 9.

FIG. 9 is a chart showing another example of the pre-write pulse and the display data write pulse.

In FIG. 9, PCTLs 0 to 3 are pulse control signals the same as those shown in FIG. 4B, and the pulse control signal PCTL2 is outputted one clock after the pulse control signal PCTL1, and the pulse control signal PCTL3 is outputted one clock after the pulse clock signal PCTL2.

The pre-write pulse PP-A is a pulse made by shifting forward by one clock the phase of a gate pulse GP having a width of two clocks generated in the gate pulse generation circuit 41 concurrently with rise of the pulse control signal PCTL1. This pre-write pulse PP-A can be generated by outputting the pulse control signal PCTL1 from the gate control signal generation circuit 4 earlier by one clock than usual (at a point of time TO) by the control of the timing controller 3, that is, by the pulse control signal PCTL0.

Further, the display data write pulse DP-A can be generated by performing mask processing in the gate pulse mask circuit 42 using the pulse control signal PCTL1 the gate pulse GP having a width of two clocks generated in the gate pulse generation circuit 41 concurrently with rise of the pulse control signal PCTL1 at a point of time T1.

Even if such pre-write pulse PP-A and display data write pulse DP-A are used, there is no change in timings (points of time T2 and T3 respectively) where the pre-write pulse PP-A and the display data write pulse DP-A fall which are timings where the voltages RV and DV applied by the data line DL are supplied to the picture element. This enables the same operation as in the liquid crystal display device shown in the above-described first and second embodiments.

Similarly, the use of a pre-write pulse PP-B made of a gate pulse GP having a width of two clocks generated concurrently with rise of the pulse control signal PCTL0, and a display data write pulse DP-B made by shifting backward by one clock the phase of a gate pulse GP having a width of two clocks generated concurrently with rise of the pulse control signal PCTL0 or made of a gate pulse GP having a width of two clocks generated concurrently with rise of the pulse control signal PCTL1, also enables the same operation as in the liquid crystal display device shown in the above-described first and second embodiments.

Further, similarly, the use of a pre-write pulse PP-C and a data write pulse DP-C obtained by performing mask processing using the pulse control signals PCTL2 and PCTL1 respectively on gate pulses GP having a width of two clocks generated concurrently with rise of the pulse control signal PCTL1, also enables the same operation as in the liquid crystal display device shown in the above-described first and second embodiments.

As described above, arbitrary pulses which fall at points of time T2 and T3 respectively can be used as the pre-write pulse PP and the data write pulse DP.

Further, a liquid crystal display device is shown as an example in the above-described first and second embodiments. The present invention, however, is not limited to the liquid crystal display device, but is also applicable to a matrix display device such as a PDP (Plasma Display Panel), an EL (Electro Luminescence) device, a display device using an LED (Light Emitting Diode) as a display section and the like.

The present embodiments are to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

As has been described, according to the present invention, a voltage which differs from a picture voltage and is quickly responsive to a change in gradation of a picture is supplied as a pre-write voltage to a picture element for displaying a picture a predetermined period before the picture voltage in accordance with the picture is supplied to the picture element via a data signal line.

This can increase the response speed in a display device to display quickly a picture regardless of a change in gradation of images displayed as pictures before and after response.

What is claimed is:

1. A matrix display device having a plurality of picture elements arranged in a matrix form, comprising:

a plurality of data signal lines for supplying to said plurality of picture elements picture voltages in accordance with a picture respectively; and a plurality of scanning signal lines for scanning said plurality of picture elements to supply to said plurality of picture elements the picture voltages supplied by said data signal lines, wherein a pre-write voltage differing from the picture voltage is supplied to said picture element a fixed time before the picture voltage is supplied to said picture element, wherein the pre-write voltage is at a gradation value always having the highest speed of response to a change in gradation, regardless of the gradation value of a picture after response, the matrix display device further having a switching circuit for selecting and outputting said picture voltage or said pre-write voltage; and a data driving circuit for supplying the selected voltage supplied from said switching circuit to said picture element via said data signal line.

2. The matrix display device according to claim 1, wherein said pre-write voltage is a fixed voltage.

3. The matrix display device according to claim 1, wherein said data signal line is driven to switch voltage from said pre-write voltage to supply said picture voltage after the supply of said pre-write voltage.

4. The matrix display device according to claim 1, wherein the pre-write voltage corresponds to white data.

5. A matrix display device having a plurality of picture elements arranged in a matrix form, comprising:

a plurality of data signal lines for supplying to said plurality of picture elements picture voltages in accordance with a picture respectively; and a plurality of scanning signal lines for scanning said plurality of picture elements to supply to said plurality of picture elements the picture voltages supplied by said data signal lines, wherein a pre-write voltage differing from the picture voltage is supplied to said picture element a fixed time before the picture voltage is supplied to said picture element, wherein the pre-write voltage is at a gradation value having a high speed of response to a change in gradation, regardless of the gradation value of a picture after response, the matrix display device further having a switching circuit for selecting and outputting said picture voltage or said pre-write voltage; and a data driving circuit for supplying the selected voltage supplied from said switching circuit to said picture element via said data signal line, wherein said scanning signal line supplies a picture write signal for supplying said picture voltage to said picture element and a pre-write signal for supplying said pre-write voltage to said picture element.

6. The matrix display device according to claim 5, wherein said picture write signal and said pre-write signal are pulsed signals, said picture write signal falls while said picture voltage is supplied to said picture element via said data signal line, and said pre-write signal falls while said pre-write voltage is supplied to said picture element via said data signal line.

7. The matrix display device according to claim 5, wherein said data signal line is driven to switch voltage from said pre-write voltage to supply said picture voltage after the supply of said pre-write voltage, said picture write signal is supplied by any one of said plurality of scanning signal lines, and said pre-write signal is supplied by at least one scanning signal line differing from said one scanning signal line.

8. The matrix display device according to claim 5, wherein said picture write signal and said pre-write signal differ from each other in at least one of signal width and phase.

9. The matrix display device according to claim 5, wherein said picture write signal and said pre-write signal differ from each other in signal width, said device, further comprising:

a pulse generation circuit for generating said picture write signal; and a pulse mask circuit for generating said pre-write signal by masking a part of said picture write signal generated in said pulse generation circuit.

10. A matrix display device having a plurality of picture elements arranged in a matrix form, comprising:

a plurality of data signal lines for supplying to said plurality of picture elements picture voltages in accordance with a picture respectively; and a plurality of scanning signal lines for scanning said plurality of picture elements to supply to said plurality of picture elements the picture voltages supplied by said data signal lines, wherein a pre-write voltage differing from the picture voltage is supplied to said picture element a fixed time before the picture voltage is supplied to said picture element, wherein the pre-write voltage is at a gradation value having a high speed of response to a change in gradation, regardless of the gradation value of a picture after response, the matrix display device further having a switching circuit for selecting and outputting said picture voltage or said pre-write voltage; and a data driving circuit for supplying the selected voltage supplied from said switching circuit to said picture element via said data signal line, wherein if a decrease in contrast occurs in a picture according to a picture voltage to be supplied to said picture element, the supply of said pre-write voltage to said picture element is stopped.

11. The matrix display device according to claim 10, wherein the supply of said pre-write voltage to said picture element is stopped by preventing said pre-write signal for supplying said pre-write voltage to said picture element from being supplied to said picture element via said scanning signal line.

12. The matrix display device according to claim 10, wherein a decrease in contrast occurring in said picture is caused by said picture voltage, and when said picture voltage is smaller than a threshold value, the supply of said pre-write voltage to said picture element is stopped.

13. A matrix display device having a plurality of picture elements arranged in a matrix form, comprising:

a plurality of data signal lines for supplying to said plurality of picture elements picture voltages in accordance with a picture respectively; and a plurality of scanning signal lines for scanning said plurality of picture elements to supply to said plurality of picture elements the picture voltages supplied by said data signal lines, wherein a pre-write voltage differing from the picture voltage is supplied to said picture element a fixed time before the picture voltage is supplied to said picture element, wherein the pre-write voltage is at a gradation value having a high speed of response to a change in gradation, regardless of the gradation value of a picture after response, the matrix display device further having a switching circuit for selecting and outputting said picture voltage or said pre-write voltage; and a data driving circuit for supplying the selected voltage supplied from said switching circuit to said picture element via said data signal line, wherein if a decrease in contrast occurs in a picture according to said picture voltage to be supplied to said picture element, said picture voltage is supplied as said pre-write voltage.

14. A method of driving a matrix display device having a plurality of picture elements arranged in a matrix form at intersections of a plurality of data signal lines and a plurality of scanning signal lines, comprising the steps of:

selecting and outputting, via a switching circuit, a picture voltage in accordance with a picture or a pre-write voltage differing from said picture voltage, wherein the pre-write voltage is at a gradation value always having the highest speed of response to a change in gradation, regardless of the gradation value of a picture after response, supplying, via a data driving circuit, the selected voltage to said picture element via said data signal lines; and supplying said pre-write voltage to said picture element a fixed time before said picture voltage is supplied to said picture element.

15. The method of driving a matrix display device according to claim 14, wherein said pre-write voltage is a fixed voltage.

16. The method of driving a matrix display device according to claim 14, further comprising the step of:

driving said data signal line to supply said picture voltage subsequently to the supply of said pre-write voltage to said picture element via said data signal line.

17. The method of driving a matrix display device according to claim 14, further comprising the step of:

supplying to said picture element a pre-write signal for supplying said pre-write voltage to said picture element; and thereafter, supplying to said picture element a picture write signal having a signal width and phase at least one of which differs from that of said pre-write signal and for supplying said picture voltage to said picture element.

18. The method of driving a matrix display device according to claim 17, wherein said pre-write signal is generated by masking a part of said picture write signal.

19. The method of driving a matrix display device according to claim 14, wherein the pre-write voltage corresponds to white data.

* * * * *